United States Patent [19]

Zimmer

[11] Patent Number: 4,665,723

[45] Date of Patent: May 19, 1987

[54] NOZZLE ASSEMBLY FOR APPLYING LIQUID TO A MOVING WEB

[76] Inventor: Johannes Zimmer, Ebentaler Strasse 133, 9020 Klagenfurt, Austria

[21] Appl. No.: 658,125

[22] Filed: Oct. 5, 1984

[30] Foreign Application Priority Data

Oct. 7, 1983 [AT] Austria ..... 3585/83
Apr. 9, 1984 [AT] Austria ..... 1193/84

[51] Int. Cl.[4] ..... D06F 1/08

[52] U.S. Cl. ..... 68/200; 101/120; 118/406; 118/674; 118/692

[58] Field of Search ..... 68/200; 118/406, 674, 118/692; 101/119, 120; 239/533, 590.3, 590.5; 222/55

[56] References Cited

U.S. PATENT DOCUMENTS

| | | | |
|---|---|---|---|
| 3,156,582 | 11/1964 | Parker | 118/692 X |
| 3,890,896 | 6/1975 | Zimmer | 118/406 X |
| 3,921,520 | 11/1975 | Zimmer | 118/406 X |
| 3,949,666 | 4/1976 | Zimmer | 118/406 X |
| 3,999,479 | 12/1976 | Zimmer | 101/120 |
| 4,023,487 | 5/1977 | Mitter | 101/120 |
| 4,498,318 | 2/1985 | Mitter | 68/200 |

FOREIGN PATENT DOCUMENTS 95085 11/1983 European Pat. Off. ..... 68/200

*Primary Examiner*—Philip R. Coe
*Attorney, Agent, or Firm*—Karl F. Ross; Herbert Dubno

[57] ABSTRACT

A nozzle assembly for applying a treatment liquid to a web moving horizontally in a predetermined direction and having a width measured horizontally perpendicular to the direction has a body extending longitudinally above the goods the full width thereof and formed with a longitudinally extending body chamber. The liquid is supplied to the chamber via appropriate passages and conduits. A nozzle bar secured to the body is formed with a bar chamber extending longitudinally the full length thereof and with an outlet slot opening downward from the bar chamber. The bar and body are formed with at least one upright connecting passage between the chambers. Thus the liquid in the body chamber flows via the passage into the bar chamber. The liquid is distributed uniformly the length of the chambers, principally by maintaining a generally constant pressure on the liquid in the body chamber. The pressure can be maintained by a piston upwardly closing and vertically displaceable in the chamber. Weights or springs bear downward on the piston with a generally constant force.

16 Claims, 7 Drawing Figures

NOZZLE ASSEMBLY FOR APPLYING LIQUID TO A MOVING WEB

FIELD OF THE INVENTION

The present invention relates to a nozzle assembly for applying liquid to a moving web. More particularly this invention concerns such an assembly for printing or dyeing a textile that is moving past the assembly at high speed.

BACKGROUND OF THE INVENTION

In the dyeing, screen printing, stenciling, and similar treatment of a textile in production the treatment liquid must be applied across the full width of the goods, over a distance that can be as great as 5 m. It is therefore necessary that the flow of the treatment liquid be controlled accurately so that no one region of the goods receives more liquid than another. This uniformity of flow is rarely achieved.

In addition it is extremely difficult when a thick foam or such liquid is being applied to achieve even flow. The liquid itself does not flow well and has little hydrostatic pressure because of its viscosity. Such foaming or viscous treatment liquids are, however, fairly common.

These problems are further all complicated with today's wide goods and high treatment speeds. When the goods are wide and moving fast it is almost impossible to apply a uniform coat of the liquid to them, a problem which is compounded when the liquid must be applied lightly or in a thin layer and when the liquid is highly viscous.

OBJECTS OF THE INVENTION

It is therefore an object of the present invention to provide an improved nozzle assembly for applying liquid to a moving web.

Another object is the provision of such a nozzle assembly for applying liquid to a moving web which applies the liquid extremely evenly along the full length of the nozzle, which corresponds to the width of the goods being treated.

SUMMARY OF THE INVENTION

A nozzle assembly for applying a treatment liquid to a web moving horizontally in a predetermined direction and having a width measured horizontally perpendicular to the direction according to the invention has a body extending longitudinally above the goods the full width thereof and formed with a longitudinally extending body chamber. The liquid is supplied to the chamber via appropriate passages and conduits. A nozzle bar secured to the body is formed with a bar chamber extending longitudinally the full length thereof and with an outlet slot opening downward from the bar chamber. The bar and body are formed with at least one upright connecting passage between the chambers. Thus the liquid in the body chamber flows via the passage into the bar chamber. The liquid is distributed according to the invention uniformly the length of the chambers, principally by maintaining a generally constant pressure on the liquid in the body chamber.

This pressure can be maintained according to this invention by a piston upwardly closing and vertically displaceable in the chamber. Weights or springs bear downward on the piston with a generally constant force. This makes it very easy to maintain a nearly perfectly constant pressure, because the mass of the weights or the spring force is normally much greater than the hydrostatic pressure resulting from the liquid's own mass. The piston is upwardly cupped to receive the weight, making adjustment easy simply by changing weights.

According to another feature of this invention the body is limitedly vertically displaceable, and the body and bar are urged downward against the web. This means can be a magnet underneath the web and a magnetically attractable member on the bar. The attractable member extends longitudinally the full length of the bar and is downstream of the slot and the magnet can be an electromagnet.

In accordance with another feature of this invention the liquid is distributed by at least one distributing passage opening at the bottom of the bar chamber. This passage meanders, that is has a plurality of generally parallel and horizontal sections joined at alternate ends, and is of downwardly decreasing flow cross section. This distributing passage can be formed in the body and/or in the piston of the liquid chamber.

The slot according to this invention has an upstream side and a downstream side. The bar has a longitudinally extending flexible blade, roller, or rigid plate forming at least one of the sides. Any combination of such blades, plates, and rollers if possible.

The supply of this invention includes a pump connected between the supply and the chamber. The speed of the web in the direction is detected by an appropriate sensor or right from the web drive and the pressure in the bar chamber is controlled by regulating the pump to increase pressure with increasing speed and decrease pressure with decreasing speed.

It is also possible to detect the pressure of the liquid in the chamber and control this pressure to maintain it constant.

DESCRIPTION OF THE DRAWING

The above and other features and advantages will become more readily apparent from the following, it being understood that any feature described with reference to one embodiment of the invention can be used where possible with any other embodiment. In the accompanying drawing.

SPECIFIC DESCRIPTION

Figure 1:
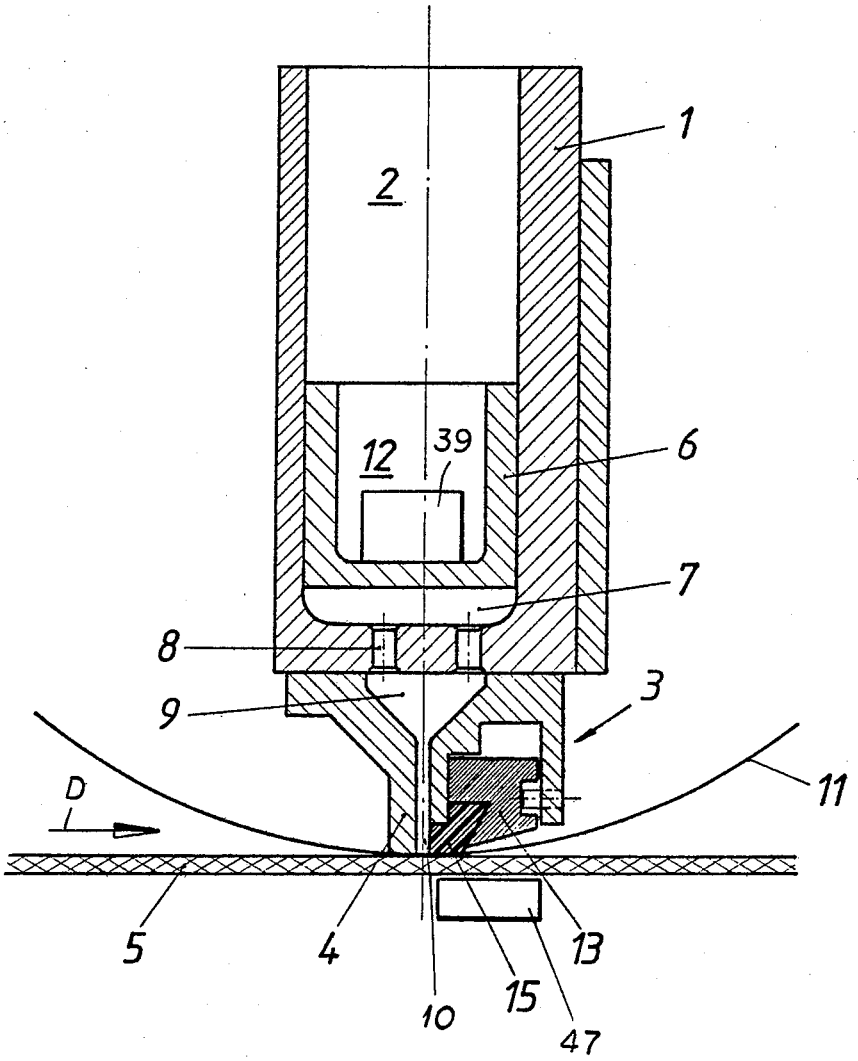
FIG. 1 is a vertical cross section through the nozzle assembly according to this invention.

As seen in FIG. 1 a nozzle assembly according to this invention has a limitedly vertically displaceable body 1 formed with an upwardly open chamber 2 in which a piston 6 is vertically displaceable. This chamber 2 is filled below the piston with a body 7 of a liquid to be applied to a web 5 moving horizontally underneath it in a direction D perpendicular to the length direction of the assembly, which here is perpendicular to the plane of the view. Underneath this body 1 is a nozzle bar 3 that also extends the full length of the body 1 and width of the goods 5 and that is formed with a full-length chamber 9 that communicates via passages 8 with the bottom of the chamber 2. In turn the bottom of this chamber 9 opens downward into a full-length nozzle slot or orifice 10 that is formed in the lower end of the bar 3. The rear edge of this slot 10 is formed by a synthetic-resin strip 15 of polytetrafluoroethylene or the like to reduce wear of the assembly. The upstream side 4 of the slot 10 is here formed unitarily with the nozzle bar 3. In addition a template, stencil, or screen 11 can be interposed between the nozzle assembly and the goods 5.

A magnetically attractable, e.g. iron, body 13 extends the full length of the bar 3 slightly downstream of the nozzle slot 10. Underneath the goods is a magnet 47 which draws the bar 13 and the entire nozzle assembly downward with some force to keep the nozzle slot 10 in good contact with the goods 5 or stencil 11. This magnet 47 can be an electromagnet so the biasing force can be controlled.

The pressure on the body 7 of the liquid being applied to the goods 5 is determined mainly by the force the piston 6 exerts downward on this body 7 in the chamber 2. This force in turn can be regulated simply by changing weights 39 inside the upwardly cupped piston 6.

Figure 2:
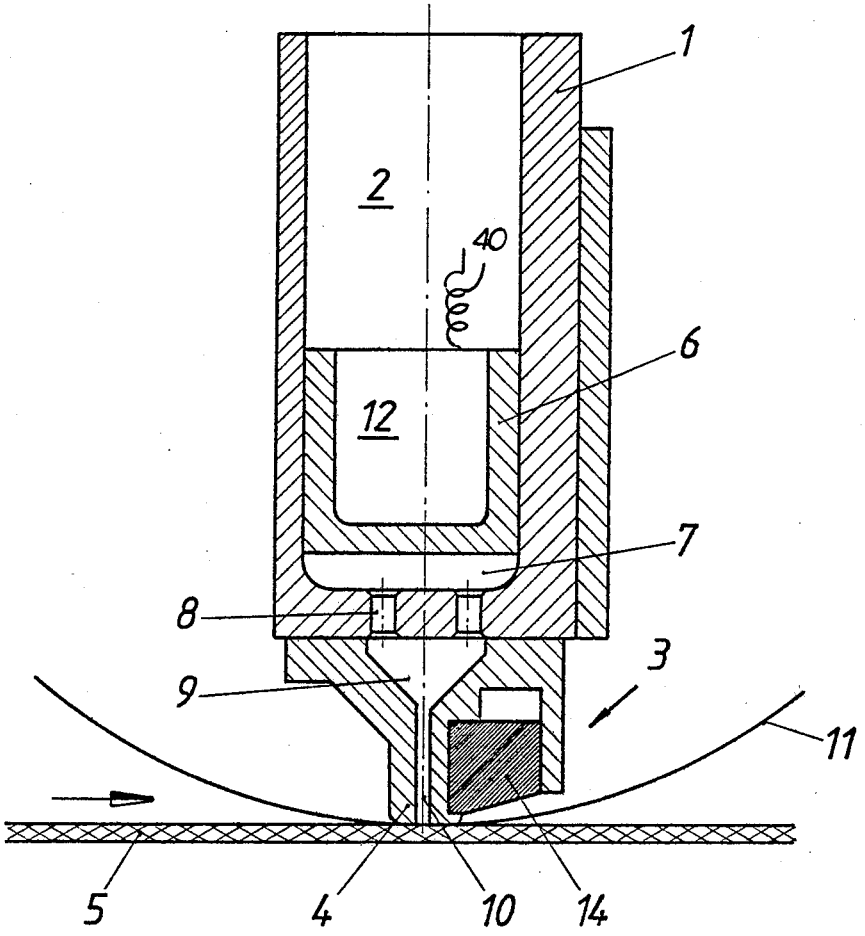
FIG. 2 is a view like FIG. 1 but showing a variant on the assembly of FIG. 1.

The arrangement of FIG. 2 is identical to that of FIG. 1 except that the weights 39 are replaced by a spring biasing system shown schematically at 40 and the rub strip 15 is eliminated so that the body 14 can be bigger. This system works the same as that of FIG. 1 except that liquid pressure is varied by changing the spring force.

Figure 3:
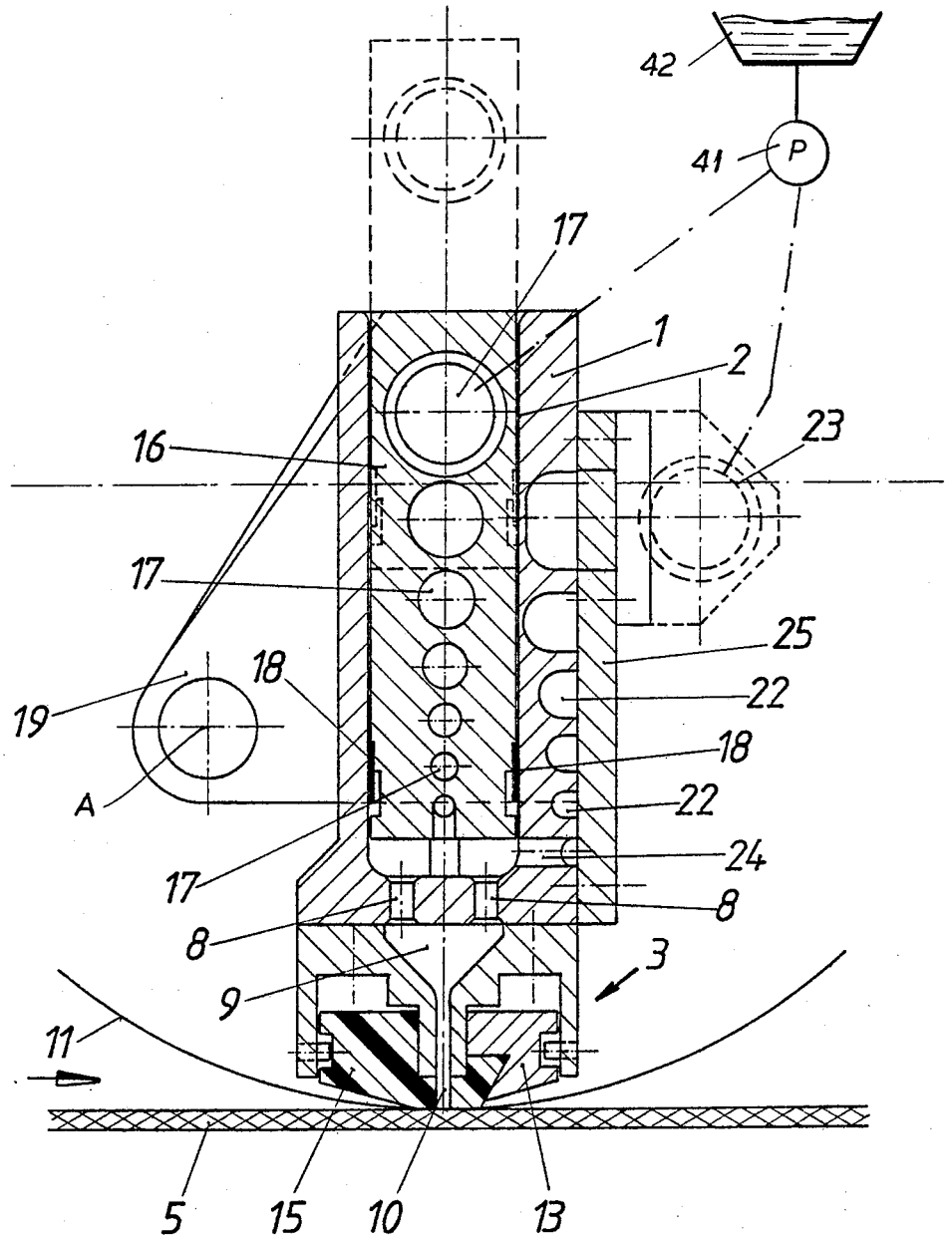
FIGS. 3 and 4 are views like FIG. 1 but showing second and third embodiments of this invention.

In FIG. 3 the housing 1 is pivotal about a horizontal axis A extending through mounting flanges 19 on its upstream or front side, so that the necessary vertical mobility is made possible by this pivoting. Here the piston 16 is not upwardly concave, but is formed with a meandering passage 17 having a succession of longitudinally extending sections of decreasing diameter that open at the bottom of this piston 16 into the chamber 2. Seals 18 prevent leakage between the piston 16 and the body 1. Similarly the housing 1 is formed with a meandering passage 22 whose section decreases downward and that opens at its bottom end 24 into the chamber 2 underneath the piston 16. A feed conduit 23 supplies liquid to the top of this passage 22, which is closed on the downstream side by a plate 25 bolted to the body 1.

A pump 41 supplies liquid from a supply 42 to the upper ends of both passages 17 and 22, 23. In addition in this system both sides of the nozzle slot 10 are defined a low-friction rub strip 15.

Figure 4:
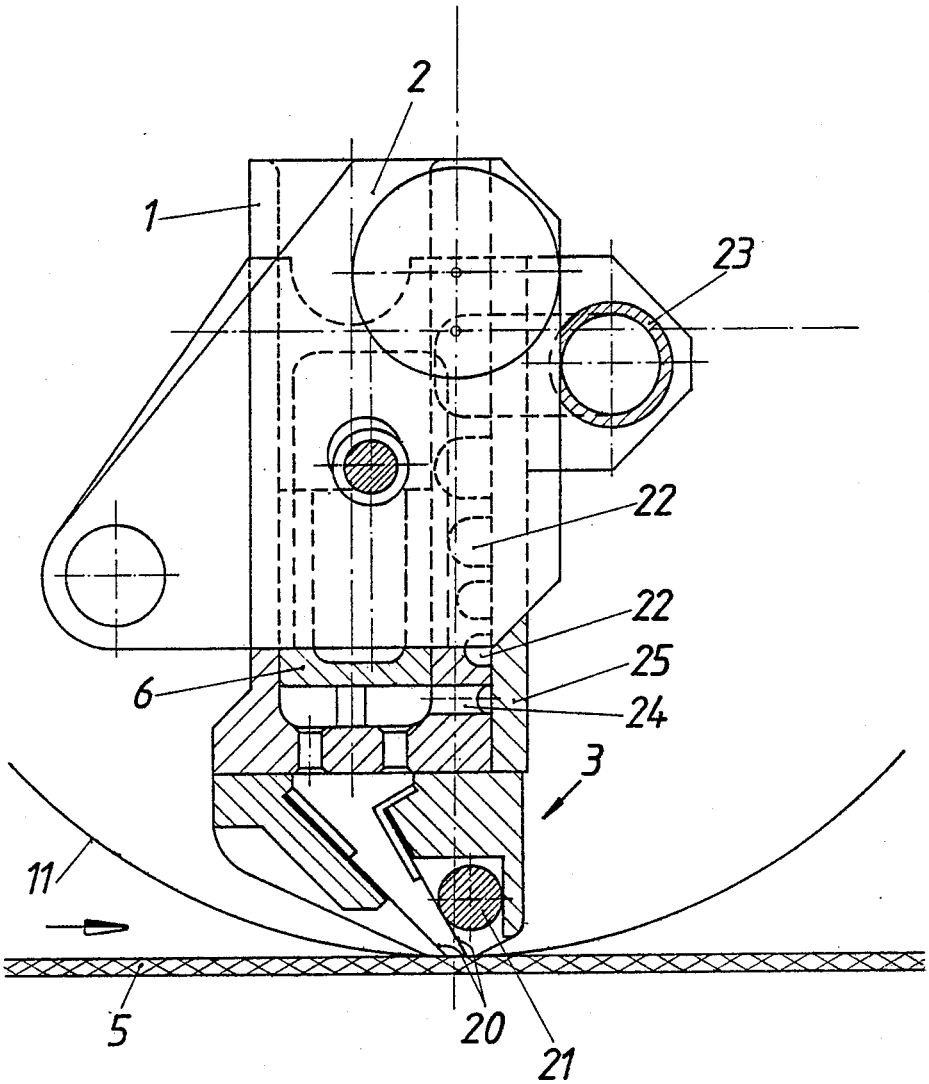

The arrangement of FIG. 4 is similar to that of FIG. 1 with an upwardly open piston 6, but the nozzle slot is defined by two flexible blades 20. A magnetically attractable mass in the form of a downstream rod 21 is provided to bias the assembly against the goods 5.

Figure 5:
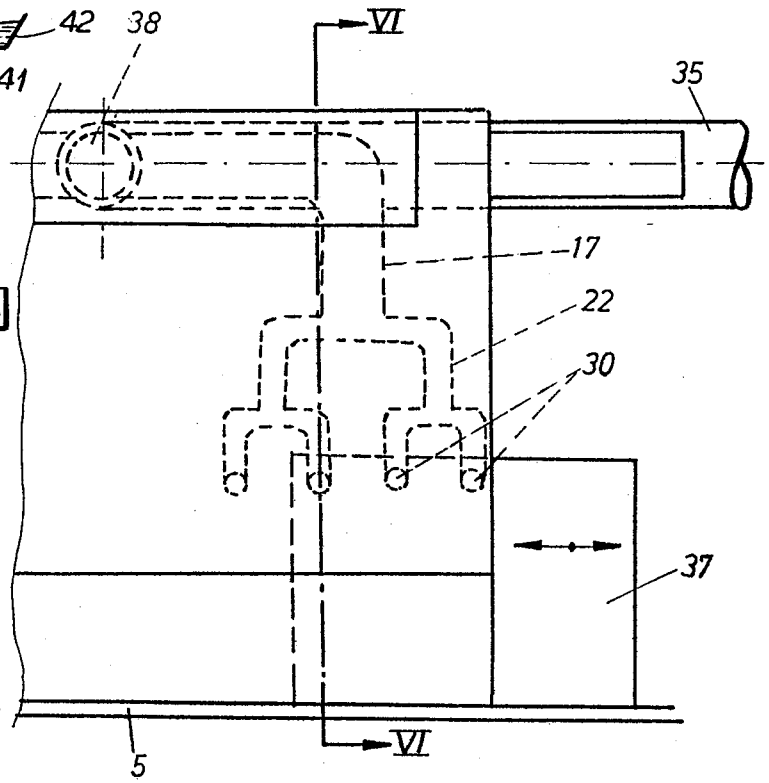
FIG. 5 is a longitudinal end view showing a fourth embodiment of the invention.
Figure 6:
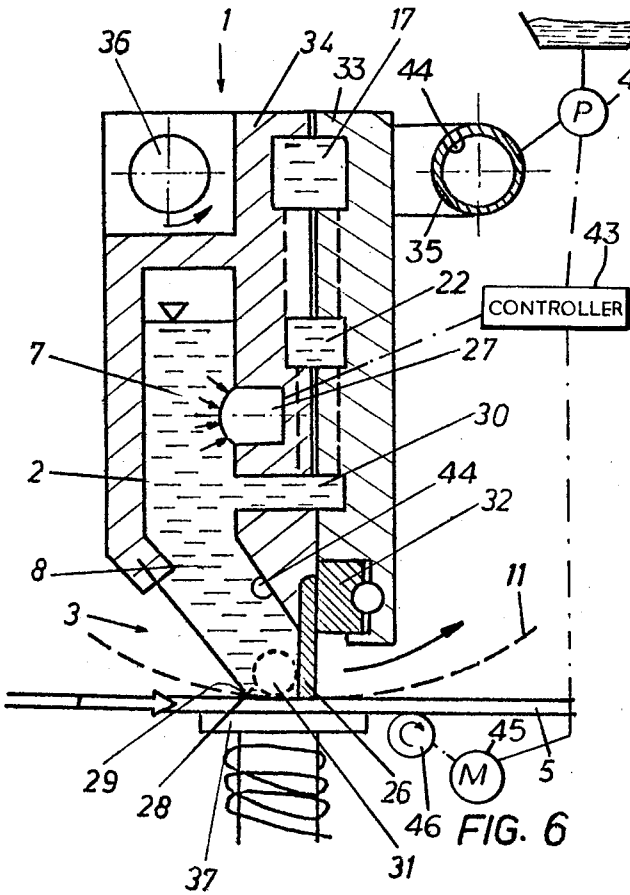
FIG. 6 is a section taken along line VI—VI of FIG. 5.

In FIGS. 5 and 6 a controller 43 is connected to a sensor 27 in the chamber 2 to monitor the pressure therein, and to the pump 41 as well as to a drive motor 45 for a drive roller 46 that advances the goods 5. As goods speed increases, the pump 41 is operated to increase the pressure in the chamber 2, which is here substantially closed.

The housing 1 here pivots on an axle 36, and is formed with a passage 17, 22 of decreasing section, formed in this case between two plates 33 and 34 that form the housing. These passages 17, 22 branch downward as shown in FIG. 5, opening at small-diameter lower ends 30 into the lower region of the chamber 2. The upper end of the passages 17, 22 opens centrally at 38 into a supply pipe 35 provided with another pressure sensor 44 and connected to the pump 41.

A nozzle slot 28 is here formed on its upstream side by a flexible blade 39 and on its lower side by a rigid bar 26 and a roller 31. The longitudinal length of this slot 28 can be adjusted by means of a longitudinally slidable blocking plate 37 that can fill the entire slot 28 and also block the lower ends 30. An electromagnet 37 attracts a downstream ferrous bar 32 to hold the arrangement down against the goods 5 and/or against the stencil 11.

Figure 7:
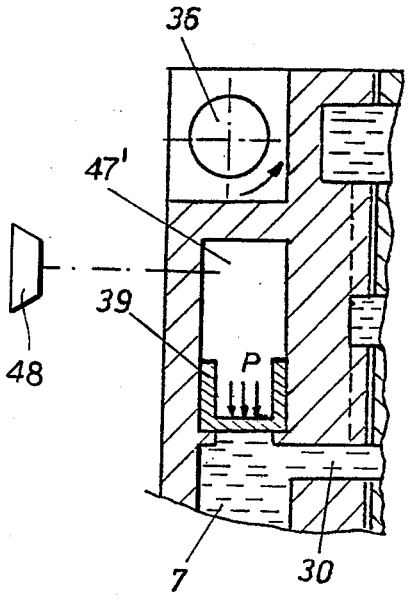
FIG. 7 is a view corresponding to a detail of FIG. 6 but showing a variant of the fourth embodiment.

It is also possible as shown in FIG. 7 to provide a piston 39 in the chamber 2 above the liquid body 7. The space 47' above this piston 39 can be pressurized by a pump 48 to control the liquid pressure also.

I claim:

1. A nozzle assembly for applying a treatment liquid to a web moving in a predetermined travel direction and having a width measured horizontally in a predetermined longitudinal direction prependicular to the travel direction, the assembly comprising:

a body extending longitudinally above the web the full width thereof;

means supporting the body for at least limited transverse movement toward and away from the web;

a nozzle bar secured to the body, formed with a bar chamber extending longitudinally the full longitudinal width of the web, and formed with a longitudinally extending outlet slot opening from the bar chamber toward the web, the bar and body being formed with a distributing passage having an inlet and an outlet opening into the bar chamber and of downwardly decreasing flow cross section between the inlet and outlet;

means for supplying the liquid under substantially constant pressure to the inlet so that the liquid flows via the passage into and is distributed thereby along the bar chamber;

a magnetically attractable member extending longitudinally along the bar adjacent the slot; and means for forming a magnetic field passing through the member for urging same and the bar toward the web.

2. The nozzle assembly defined in claim 1 wherein the pressurizing means includes a piston upwardly closing and vertically displaceable in the chamber and means for bearing down on the piston with a generally constant force.

3. The nozzle assembly defined in claim 2 wherein the means for bearing down includes a removable weight sitting on the piston.

4. The nozzle assembly defined in claim 3 wherein the piston is upwardly cupped to receive the weight.

5. The nozzle assembly defined in claim 2 wherein the means for bearing down includes a spring bearing downward on the piston.

6. The nozzle assembly defined in claim 1 wherein the attractable member extends longitudinally the full length of the bar and is downstream of the slot.

7. The nozzle assembly defined in claim 1 wherein the field-forming means is an electromagnet.

8. The nozzle assembly defined in claim 1 wherein wherein the distributing passage meanders.

9. The nozzle assembly defined in claim 8, wherein the distributing passage is formed in the body.

10. The nozzle assembly defined in claim 8, further comprising:

a piston upwardly closing and vertically displaceable in the chamber and formed with the distributing passage.

11. The nozzle assembly defined in claim 1 wherein slot has an upstream side and a downstream side, the bar having a longitudinally extending flexible blade forming at least one of the sides.

12. The nozzle assembly defined in claim 1 wherein the slot has an upstream side and a downstream side, the bar having a longitudinally extending roller forming at least one of the sides.

13. The nozzle assembly defined in claim 1 wherein the slot has an upstream side and a downstream side, the bar having a longitudinally extending rigid plate forming at least one of the sides.

14. The nozzle assembly defined in claim 1 wherein the supply means includes a pump connected between the supply and the chamber, the apparatus further comprising:

means for detecting the speed of the web in the travel direction; and control means connected between the pump and the detecting means for controlling the pressure in the bar chamber in accordance with speed by increasing pressure with increasing speed and decreasing pressure with decreasing speed.

15. The nozzle assembly defined in claim 1 wherein the supply means includes supply and a pump connected between the supply and the chamber, the distributing means further comprising:

means for detecting the pressure of the liquid in the chamber; and control means connected between the pump and the detecting means for maintaining the pressure in the bar chamber generally constant.

16. The nozzle assembly defined in claim 1 wherein two separate elements define the distributing passage.

* * * * *